US005799263A

United States Patent [19]

Culbertson

[11] Patent Number: 5,799,263

[45] Date of Patent: Aug. 25, 1998

[54] PUBLIC TRANSIT SYSTEM AND APPARATUS AND METHOD FOR DISPATCHING PUBLIC TRANSIT VEHICLES

[75] Inventor: Russell D. Culbertson, Austin, Tex.

[73] Assignee: BCT Systems, Austin, Tex.

[21] Appl. No.: 631,147

[22] Filed: Apr. 15, 1996

[51] Int. Cl.[6] ..... G08G 1/123

[52] U.S. Cl. ..... 701/117; 340/994

[58] Field of Search ..... 364/423.098, 436, 364/446, 444.1; 340/988, 989, 994; 701/1, 117, 201, 204

[56] References Cited

U.S. PATENT DOCUMENTS

| | | | |
|---|---|---|---|
| 4,350,969 | 9/1982 | Greer | 340/994 |
| 4,360,875 | 11/1982 | Behnke | 364/436 |
| 5,168,451 | 12/1992 | Bolger | 364/436 |
| 5,493,295 | 2/1996 | Lewiner et al. | 340/994 |
| 5,541,845 | 7/1996 | Klein | 364/449.1 |
| 5,559,707 | 9/1996 | DeLorme et al. | 364/443 |
| 5,602,739 | 2/1997 | Haagenstad et al. | 364/436 |

*Primary Examiner*—Michael Zanelli
*Assistant Examiner*—Edward Pipala

[57] ABSTRACT

A public transit system uses a plurality of intracell vehicles to service transit requests in individual transit cells, and the transit cells are connected by intracell vehicles which travel between cell terminals located within the respective transit cells. The intracell vehicles are automatically dispatched by a dispatching system (12) which assigns each transit request to an intracell vehicle servicing a matching transit route or soft route comprising a geographical area and a route travel direction. The dispatching system (12) uses a process for selecting the most appropriate vehicle to handle a transit request where no prior route matches the request. This initial transit request then defines a new soft route for the vehicle to which it is assigned. Transit requests are preferably communicated to the dispatching system via a local telephone system and locations within the transit cell are defined by telephone numbers or other suitable identifiers.

31 Claims, 5 Drawing Sheets

PUBLIC TRANSIT SYSTEM AND APPARATUS AND METHOD FOR DISPATCHING PUBLIC TRANSIT VEHICLES

BACKGROUND OF THE INVENTION

This invention relates to public transit systems, and more particularly, to a transit system in which transit requests are automatically processed without human intervention and vehicles are automatically dispatched to service such requests.

For a number of reasons, the vast majority of communities in the United States and in many other geographic regions have grown to rely on individual transportation, that is, transportation through individually owned automobiles or cars, rather than public or mass transit. This reliance on individual transportation has raised a number of very serious problems. The first and most serious problem is the environmental damage caused by traditional individual transportation vehicles which are powered by internal combustion engines. The operation of internal combustion engines releases pollutants into the atmosphere causing air pollution. Also, individual transportation vehicles drop lubricants and other chemicals along roadways and parking areas, and these pollutants are periodically washed off by rain water to pollute ground water, lakes, and rivers. Furthermore, maintaining individual transportation vehicles produces huge quantities of pollutants, such as used motor oil for example, which are commonly not handled or recycled properly.

Another serious problem with traditional individual transportation relates simply to the cost of such a transportation system, even aside from the environmental costs. With no viable public transportation in many areas, a family generally must own and maintain multiple vehicles. The cost of acquiring and operating motor vehicles represents the largest monthly expense for many families. Repair costs and insurance add further to the financial burden associated with individual transportation vehicles. Personal injury associated with the operation of individual transportation vehicles must also be considered as a cost of the individual transportation system. Finally, aside from the private costs of owning, operating, and maintaining individual transportation vehicles, the costs of building and maintaining roads and highways and the infrastructure required for individual transportation vehicles represents a huge drain on public funds. Considering the environmental costs, along with the direct private and public costs of the traditional individual transportation system, the total cost of the system is truly staggering.

Perhaps most importantly, the reliance on individual transportation has made it difficult or impossible to switch to conventional mass transit. The reason for this difficulty is that the infrastructure that is required for individual transportation prevents conventional mass transit from operating efficiently. For example, when relying on an individual transportation system, retail establishments and business centers require substantial spacing to accommodate parking for cars. This spacing required for the cars combined with the low population density of urban and suburban areas that cars accommodate, make traditional mass transit systems simply too inefficient to be competitive. In this way, the reliance on cars for day-to-day transportation is not unlike an addiction. The more we use and rely on the system, the more the system is required to perpetuate itself and the more difficult it is to switch to an alternate system.

Traditional mass transit systems include buses operating on fixed routes as well as light rail and regular rail systems.

Where rail systems are in place in relatively high population density areas, the systems commonly enjoy very high ridership. However, the cost of installing rail systems effectively prohibits their use in many areas. Furthermore, low population density urban and suburban areas can never be efficiently serviced by rail systems alone. That is, even if a rail system provided a link between a suburban area and a downtown area, for example, users must still find some way to travel from their residence to a rail station and from a downtown terminal to their final downtown destination.

Traditional bus systems in which the buses operate on fixed routes have proven simply too inefficient to compete with automobile transportation. One reason for this inefficiency is that fixed bus routes are so tied to traffic that it is virtually impossible to maintain a schedule. Furthermore, large buses operating on heavily traveled roads interfere with automobile traffic. Also, in the low population density urban and suburban areas, at least in the United States, fixed bus routes must be spaced so widely that it is difficult or inconvenient for people to even reach the nearest bus stop. Transfers between routes are also difficult to coordinate. The fact of the matter is that traditional fixed route bus transportation systems are so inefficient that only those who must use the system for economic reasons actually use the system. Aside from the general inconvenience of a traditional bus system, the travel time required by such systems is commonly so high that many potential users cannot even consider using the mass transit system without changing lifestyles significantly.

There have been many attempts to make public transit systems more efficient. One such attempt is disclosed in U.S. Pat. No. 5,168,451, to Bolger. The Bolger Patent is directed to a user responsive transit system in which a city is divided into numerous transit cells. Transit requests within the individual cells are serviced by small vehicles that are automatically dispatched by a computerized controller according to the user requests. In the Bolger system, the requests are entered from special terminals located at intervals within the transit cell.

Although the user responsive transit system disclosed in the Bolger Patent represents an improvement over purely fixed route systems, the Bolger transportation system has several problems which have prevented its use. One problem is that the Bolger system requires numerous transit request terminals for transmitting service requests to the computer dispatch system. These transit request terminals are so expensive that the system would be difficult even to test on any realistic scale. Furthermore, the manner in which vehicles are dispatched to service transit requests is inefficient. In the system disclosed in the Bolger Patent, a vehicle is chosen to service a transit request based upon the minimum added distance to service the particular request. This dispatching system invariably results in vehicle backtracking. Furthermore, during, a high usage period, there are so many transit requests in a small area that a single vehicle would end up going back and forth in a small area to pick up passengers and only be allowed to continue to its dispatched destinations after an excessive period of time. Also, the system disclosed in the Bolger Patent includes no mechanism for efficiently distributing passengers from a cell terminal such as during the evening rush hour.

SUMMARY OF THE INVENTION

It is a general object of the invention to provide a public transit system and a public transit dispatching apparatus and method that over comes the above-described problems and others associated with prior public transit systems.

In order to accomplish these objects, the dispatching system according to the invention makes the maximum use of existing infrastructure. Also, the system includes a more efficient and effective route assignment process which eliminates vehicle backtracking and makes the most efficient use of the vehicles which service transit requests.

The public transit system according to the invention is based upon transit cells, each cell covering a geographic area. Intracell vehicles service transit needs within each cell, whereas larger intercell vehicles travel between cells to link the various cells. A small town may include a single cell whereas larger towns and cities may have many different transit cells, each cell covering a different geographical portion of the entire area serviced by the transit system. The transit system according to the invention is very flexible and there is substantially no limit to the number of transit cells that may be included in the system.

Each transit cell includes a terminal located at a convenient place within the geographical area covered by the cell. Preferably, but not necessarily, terminals are centrally located in each cell. Each cell terminal includes an area for allowing public transit vehicles to pick up and drop off passengers. Preferably, the terminal includes an area for intracell vehicles and a separate area for intercell vehicles. Each cell terminal also preferably includes a plurality of telephones or other communication devices for passengers to use to make transit requests.

All dispatching according to the system is performed on an intracell basis, with transit requests being serviced by the intracell vehicles. The intracell vehicles are preferably small, 10–20 passenger vans, similar to vans used as airport shuttles, for example. For cities having two or more cells, the complete transit system requires intercell vehicles which travel between cells according to fixed routes and perhaps according to some schedule. The intercell vehicles may be large buses or rail vehicles.

According to the invention, all intracell vehicles in a particular cell are dispatched according to transit requests made directly by a user of the system. The transit request is preferably made by telephone, with the user initiating a call from their location to a dispatching computer system. A telephone communication system is associated with the dispatching computer system for receiving numerous incoming calls. In each transit request the user inputs at least a destination identifier, preferably a telephone number, and perhaps a request telephone number or other location identifier. In the preferred form of the invention, the request telephone number of an incoming transit request is captured automatically by an incoming call identification device associated with the telephone communication system. Regardless of how the request and destination telephone numbers are acquired, the telephone communication system communicates both numbers to the dispatching computer.

Upon receipt of the request and destination telephone numbers, the dispatching computer first associates the incoming request telephone number and destination telephone number with a request location and a destination location, respectively, within the transit cell, and also determines a request direction using the request and destination locations. The dispatching means or dispatching computer then assigns the respective transit request to a matching intracell vehicle route, the matching intracell vehicle route having a route area including the request location and the destination location associated with the respective transit request and also having a direction matching the direction of the transit request. In a situation where no previously assigned vehicle route matches an incoming transit request, the dispatching computer employs a process to choose the most effective vehicle to service the transit request and creates a new route for the chosen vehicle to service that request. Thereafter, the dispatching system assigns that transit request to the newly created matching intracell vehicle route. Once the assignment is made, the dispatching computer communicates dispatching information to an intracell vehicle communication apparatus or means. This intracell vehicle communications apparatus then communicates the dispatching information in the form of a dispatch signal to the vehicle assigned to the matching route.

Each intracell vehicle has mounted therein a dispatch signal display device or means for receiving dispatch signals for the particular intracell vehicle and for displaying vehicle operator information. The vehicle operator information comprises information which allows the vehicle operator to drive the respective intracell vehicle to the request location to pick up the requesting user and those accompanying that person, and eventually to drive to the destination location to drop the requesting user off. Along the way, the dispatching computer system assigns additional request locations and destination locations matching the current route to allow the intracell vehicle operator to service those requests as well.

Thus, the transit system according to the invention creates temporary routes or "soft routes" for the intracell vehicles to service various transit requests, and once those soft routes are created, assigns additional transit requests to that vehicle until the vehicle is ready to start on its next soft route. The term soft route is intended to imply that each vehicle route is not a fixed route, but rather a route comprising a geographical area defined by an initial transit request and predetermined route parameters. The dispatching computer or means essentially groups transit requests by soft routes which an intracell vehicle may efficiently service.

In the preferred form of the invention, there are three different types of soft routes, an inbound/lateral route, an outbound route, and a combination route, consisting of both inbound/lateral and outbound routes connected together to form a single route. Each type of soft route includes a geographical area according to predetermined route parameters. The difference between inbound/lateral and outbound route parameters is that outbound route parameters are fixed to produce a few easily identified route areas, whereas inbound/lateral routes may be of infinite variety depending upon an initial transit request used to position the route area. Also, outbound routes always start at the terminal location whereas inbound/lateral routes terminate at the terminal location. The identifiable nature of outbound routes allows passengers at the terminal to simply enter the appropriate vehicle without making a request. The user enters the desired destination telephone number when entering the vehicle and this input is used to create information displayed to the vehicle operator to allow the operator to drive to each entered destination location.

The transit system and dispatching apparatus and method according to the invention has several advantages over prior public transit systems. First, by using a telephone system to communicate transit requests, the system makes the maximum use of existing infrastructure. To make a transit request, a user only has to know and enter the telephone number associated with their intended destination location. Thus, the system is much less expensive to implement. Also, by using a telephone system to transmit transit requests, users may initiate requests from the comfort of their own home with no need to go to a special request terminal. Furthermore, the transit request assignment process according to the invention prevents the intracell vehicles from having to backtrack to service transit requests. The assignment system and method employed according to the invention makes the most efficient use of intracell vehicles and ensures that users reach their respective desired destination as quickly as possible.

The outbound route defined according to the invention enables the intracell vehicles to effectively handle a large number of transit requests from a cell terminal to locations within the cell. These outbound transit requests from each cell terminal would occur commonly during rush hours when many users are going to their places of employment during the morning rush hours or traveling home from their local transit cell terminal during the evening rush hours.

Also, the transit system according to the invention is very flexible in that transit cells may be defined and changed as the population of a city changes. Furthermore, since the terminals require no special facilities other than relatively small areas for intracell and intercell vehicles to enter and exit, a few telephones, and a cover or enclosure for protecting passengers from the elements while awaiting intracell and intercell vehicles, the terminals may be moved readily or located substantially anywhere within a transit cell. As system ridership increases, retail areas may even bid for terminals at their location due to the advantage of having increased customer access to the area. Also, the transit system according to the invention could capture important and useful information regarding traffic to any location, including retail locations, and this information could be sold for marketing purposes. Furthermore, the public transit system according to the invention is sufficiently convenient and time efficient to compete with individual transportation and would encourage substantial ridership. The fares collected from users along with the monies collected from the sale of collected information and terminal location franchises could make the system self sufficient and require little or no public funding.

These and other objects, advantages, and features of the invention will be apparent from the following description of the preferred embodiments, considered along with the accompanying drawings.

DESCRIPTION OF THE PREFERRED EMBODIMENTS

Figure 1:
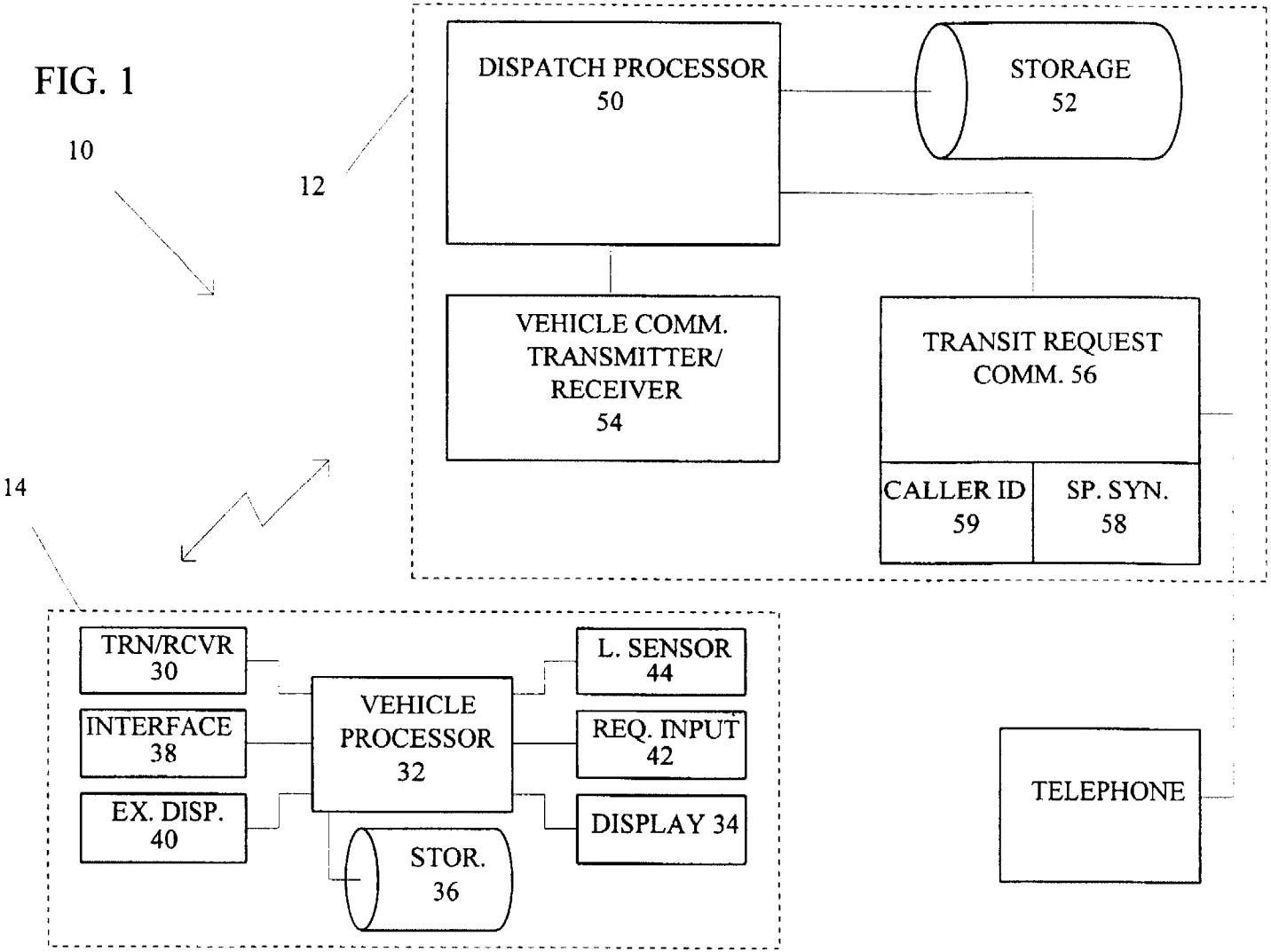
FIG. 1 is a schematic representation of the preferred form of the transit system components according to the invention.
Figure 2:
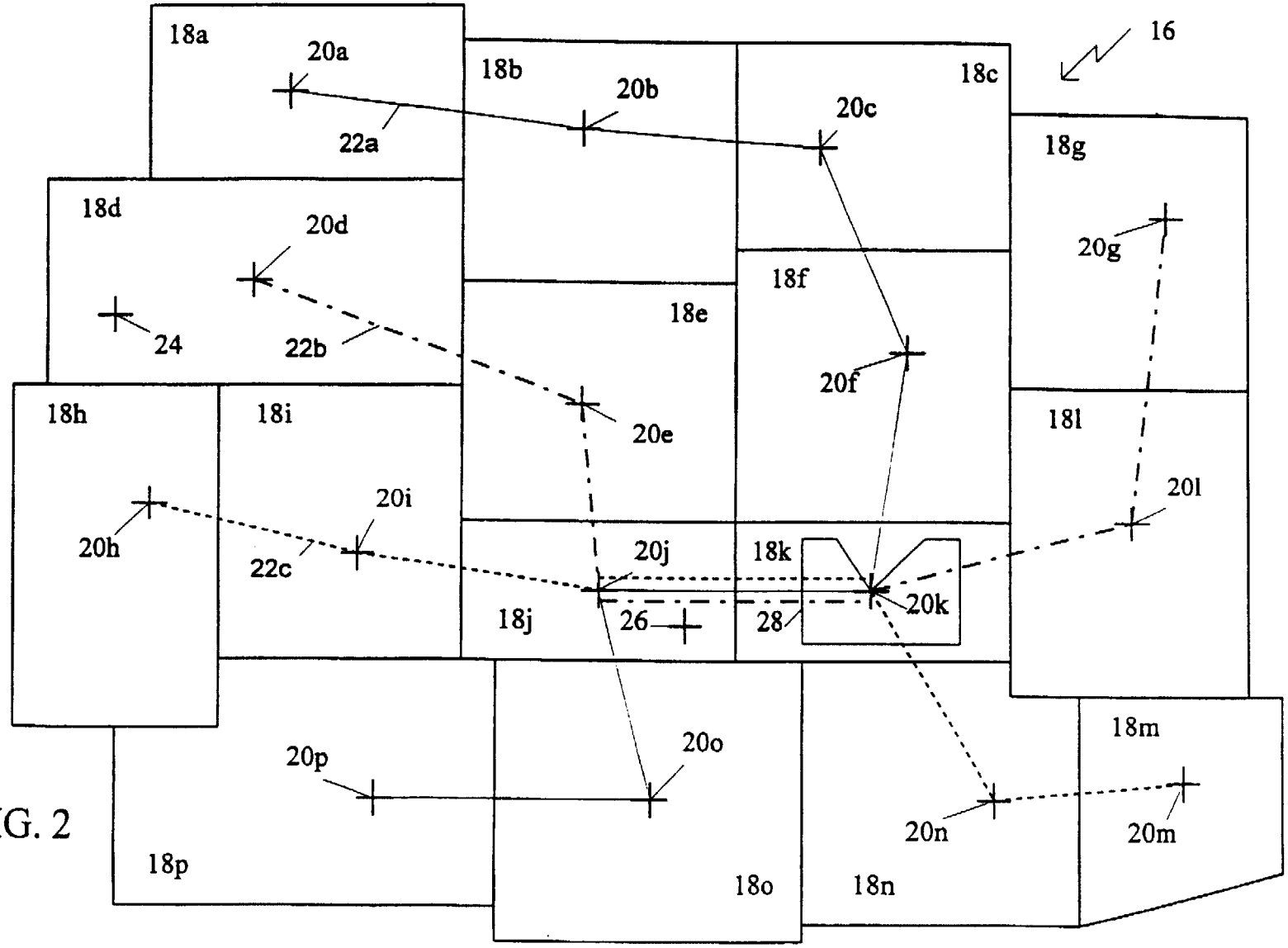
FIG. 2 is a plan view of a small city serviced by a transit system according to the invention.

Referring to FIG. 1, a public transit system 10 according to the invention includes a dispatching system 12 and a plurality of intracell vehicles (not shown), with each intracell vehicle including an intracell vehicle dispatch and status signal processing system 14. As shown in FIG. 2, a city or geographical area 16 serviced by the public transit system according to the invention is divided into a series of transit cells 18*a–p*, each transit cell comprising a certain geographical area. The transit cells 18*a–p* include a terminal location 20*a–p*, respectively, and each transit cell is serviced by a plurality of intracell transit vehicles which are preferably small, relatively low passenger capacity vans. Each transit cell 18*a–p* includes a dispatching system 12 for dispatching intracell vehicles within the associated transit cell to service transit requests made from the cell.

In the overall public transit system, according to the invention, the individual transit cells 18*a–p* are linked by intercell vehicles which may travel along fixed routes 22*a–c*. The intercell vehicles may be buses or rail vehicles, for example. By combining the automatically dispatched intracell vehicle system with fixed route intercell transit vehicles, the overall transit system according to the invention provides a cost effective and efficient public transit capability over a wide geographical area, particularly for relatively low population density areas.

For example, suppose a passenger at location 24 in transit cell 18*d* wishes to travel to a location 26 in another transit cell 18*j*. The passenger or user makes a transit request, preferably from home using their own home telephone, and the local dispatching system 12 for cell 18*d* dispatches an intracell vehicle to pick up the passenger or user and travel to the cell terminal 20*d*. At the cell terminal 20*d*, the passenger may exit the intracell vehicle and enter an appropriate intercell vehicle which travels along a route 22*b* to the desired destination transit cell 18*j*. At the destination transit cell 18*j* the passenger exits the intercell vehicle at that cell terminal 20*j* and then makes a second transit request from the destination terminal 20*j*. The local dispatching system 12 at the destination terminal 20*j* then automatically dispatches a local intracell vehicle to pick up the passenger at the terminal and travel to the desired destination location 26.

In addition to the automatically dispatched intracell vehicles which have no fixed routes, as will be discussed below, and the intercell vehicles which do travel along fixed routes, certain heavily traveled routes within transit cells may be serviced by fixed route vehicles of an appropriate passenger capacity. For example, referring to FIG. 2, a transit cell 18*k* which encompasses a city center or a downtown area may have fixed route intracell vehicles which travel along a loop 28 which passes through the terminal 20*k*. Also, when major shopping areas or employers are not within walking distance from a transit cell terminal, the shopping area or employer, or the transit system operator, may provide fixed route vehicles to service those areas from the local transit cell terminal. It is this combination of automatically dispatched intracell vehicles and fixed route intercell vehicles, and perhaps fixed route intracell vehicles, which provide the desired comprehensive transit system. The key to the system, however, and the component that facilitates efficient operation of the fixed route vehicles, is the automatically dispatched intracell vehicles and associated dispatching system. The automatically dispatched intracell vehicles literally allow a user to travel from their own home to any place within the local transit cell and, using the intercell vehicles, to any location within any transit cell within the overall transit area 16.

Referring particularly to FIG. 1, each transit cell vehicle (vehicle not shown) includes a transmitter and receiver 30 for receiving dispatch signals from the dispatching system 12 and for transmitting vehicle status signals to the dispatching system. The dispatch signals received by the transmitter/receiver 30 are passed along to a vehicle processor 32 and the processor causes the appropriate dispatching information to be displayed on a vehicle display 34. Mass storage 36 associated with the vehicle processor 32 preferably stores information related to the respective transit cell and provides storage for information needed by the vehicle processor. A vehicle operator interface 38 allows the operator to at least log in and out of the system. The vehicle operator interface 38 may also be used as an inexpensive way to generate vehicle location information as the vehicle services its assigned transit requests. In the preferred form of the invention, the vehicle further includes an external vehicle display 40 for displaying vehicle ID and route information, and a vehicle transit request input 42 which enables a user or passenger to input a transit request from the vehicle. Also, the vehicle may further include a vehicle location sensor such as GPS device 44 or other suitable device which may be used to produce the vehicle location component of vehicle status signals.

The transit system illustrated in FIG. 1 may be implemented with standard computer and communications hardware or specialized hardware. For example, the vehicle processor 32 may be comprised of a lap top or portable personal computer fixed on a suitable mounting bracket (not shown) within the intracell vehicle. The mass storage 36 may simply be the hard drive associated with the lap top or portable computer and the display 34 may comprise the regular lap top display. The operator interface 38 may include the lap top keyboard and cursor control and may also include the display 34 when the display comprises a touch sensitive screen. The vehicle transit request input 42 may include a numerical key pad and magnetic or optical card reader with a suitable alphanumeric display such as the devices commonly used to verify credit card purchases at retail establishments. The vehicle transmitter/receiver 30 may be any suitable communication device and preferably a two-way radio device capable of transmitting and receiving digital signals. Alternatively, the transit system may utilize cellular telephone communications for transmitting dispatch signals and vehicle status signals.

Referring still to FIG. 1, the dispatch apparatus 12 includes a dispatch processor 50 with associated mass storage 52, a vehicle communication transmitter/receiver 54, and transit request communication means 56. In the preferred form of the invention, the transit requests are communicated to the dispatching system through a regular telephone system. Transmitting a transmit request through a telephone system allows the users or passengers to make transit requests from the safety and comfort of their own home using a touchtone phone.

The transit request communication device 56 receives a transit request communicated from a system user and passes the request information along to the dispatch processor 50 for further processing. The transit request communication device 56 also transmits confirmation information over the phone line to the user and preferably includes a speech synthesizer 58 for transmitting such communications. For example, the speech synthesizer 58 may be used to transmit an appropriate indicator to the passenger or user when the user inputs an invalid destination or account identifier. Also, the transit request communications device 56 and speech synthesizer 58 may be used to transmit to the requesting user a vehicle identifier identifying the vehicle dispatched to the particular request and perhaps an estimated time of arrival at the requester's location.

As will be discussed below, the preferred form of the invention utilizes telephone numbers to identify requests and destination locations. When telephone numbers are used to identify locations, the transit request communications device 56 preferably includes a caller ID apparatus 59 for automatically capturing the telephone number of the incoming transit request. Alternatively, the requesting passenger or user may simply input their own telephone number along with the destination telephone number and an account ID, using the touchtone phone.

The vehicle communication transmitter/receiver 54 transmits dispatch signals to intracell vehicles and receives status signals from the intracell vehicles. A suitable interface between the vehicle communication transmitter/receiver 54 and the dispatch processor 50 allows the processor to control the operation of the transmitter/receiver and receive vehicle status information. Preferably, the transmitter/receiver comprises a radio capable of transmitting and receiving digital radio signals under the control of the dispatch processor 50.

The dispatch processor means 50 preferably comprises a work station or microcomputer with programming to control the dispatching process as described below. The mass storage 52 associated with the processor may comprise any suitable hard drive device with capacity for storing the data required in the dispatching process according to the invention. In the preferred form of the invention the mass storage 52 stores a phone number/location database, an assigned vehicle route database, and perhaps an accounting/performance database.

In operation, the dispatch processor 50 receives requests from the transit request communication device or subsystem 56, searches the phone number/location database to obtain the location information for the particular request including a request location and destination, and then assigns the transit request to a dispatched intracell vehicle route that includes both the request and destination location and has a route direction matching the request direction. In the preferred form of the invention, a matching request direction is a request direction that is within a predefined angle, such as 90° for example, of the route direction. Route and request directions may be defined in any suitable manner. For example, direction may be defined in terms of some angular value offset clockwise from an arbitrary reference direction. Where no existing intracell vehicle route matches the incoming transit request, the dispatch processor goes through a subprocess to assign or create a new intracell vehicle route based upon the transit request, and then assigns the transit request to the new route. Once the dispatch processor 50 makes the route assignment, the processor updates the vehicle route database and directs the vehicle communication system 54 to transmit a dispatch signal to the vehicle having the assigned route. The dispatch processor 50 also preferably directs the transit request communication system 56 and speech synthesizer 58 to synthesize a message to send back to the requesting passenger or user to indicate or identify the intracell vehicle dispatched to handle the transit request and perhaps provide additional information such as an estimated time of arrival at the request location.

Using the telephone system to enter transit requests makes the best utilization of existing infrastructure and makes use of common technology that virtually everyone is used to using. Also, using telephone numbers to identify physical locations of a request and destination again makes maximum use of existing infrastructure and makes the system easy to use. A user may simply use their phone directory to obtain all the information they need to request service.

Figure 3:
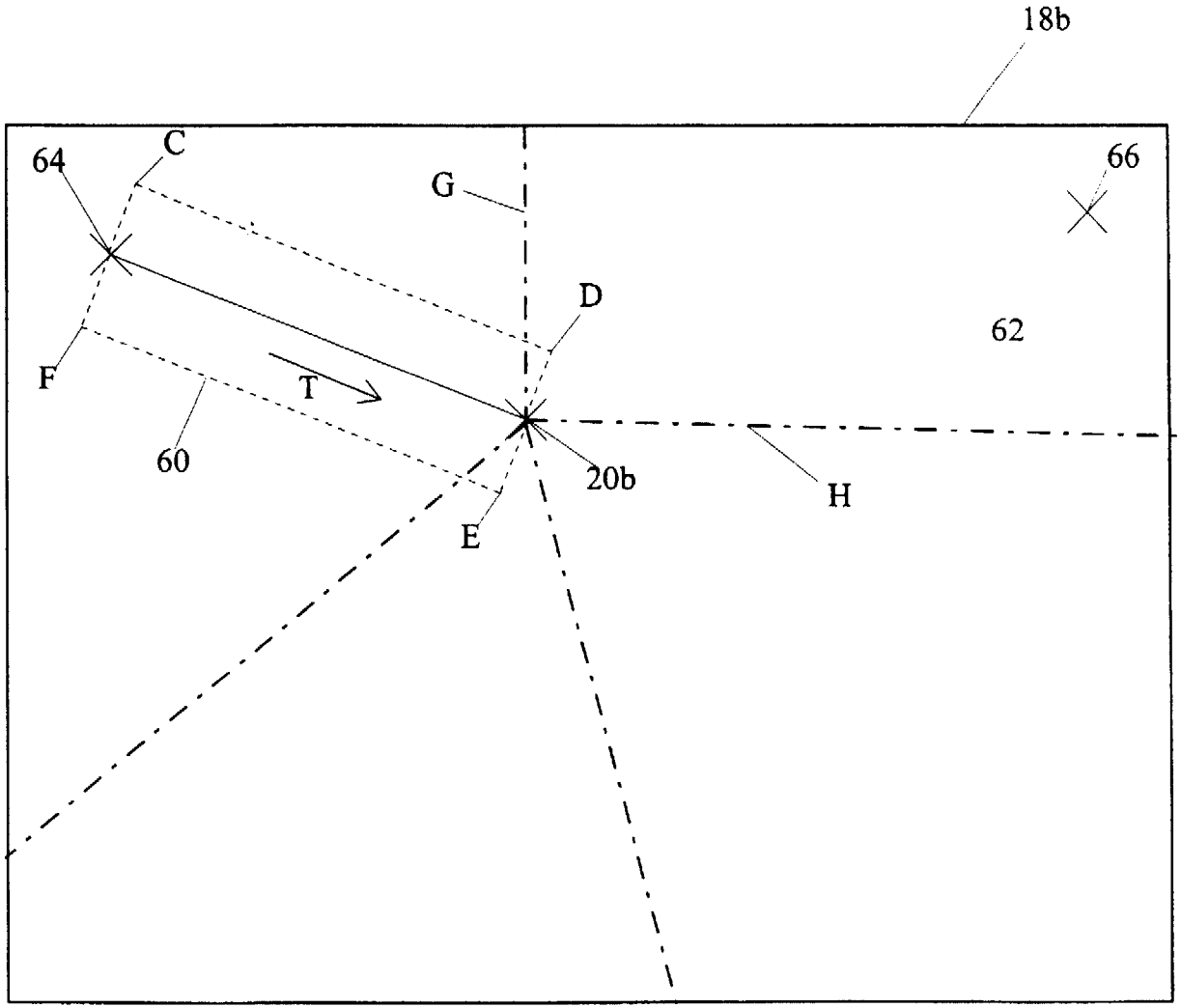
FIG. 3 is a plan view of a single transit cell according to the invention showing the three preferred types of intracell vehicle routes according to the invention.

Referring to the cell **18*b* shown in FIG. 3, the dispatching method preferably uses essentially three different types of temporary vehicle routes or "soft routes" for the intracell vehicles. By "soft route" it is meant that the route is not fixed but only assigned temporarily to service a particular request and other requests that match the route. The three different types of soft routes preferably used by the system include an inbound or lateral route 60, an outbound route 62**, and a combination of the two. Regardless of the type of route, each route is defined by a certain geographical area.

The inbound route 60 is defined by an initial transit request location 64 and destination location **20*b*. The initial request location 64 and destination location, in this case the terminal 20*b*, define a direction shown at Arrow T and a certain distance on each side of the line between the request location and destination location defines the geographic area of the route 60** bounded by points C, D, E, and F. Once an inbound route is assigned to a vehicle, additional transit requests having request and destination locations contained in the remaining geographic area of the inbound route are simply assigned to be serviced by the vehicle.

The outbound route 62 is defined by a certain sector bounded by lines G and H extending from the terminal location **20*b*. There may be three, four, or more different outbound routes or areas associated with a transit cell. When an intracell vehicle is assigned to an outbound route, such as route 62, the vehicle will linger at the terminal 20*b* to collect passengers traveling from the terminal to destinations within the assigned sector. The outbound assigned vehicle may identify the outbound route sector to which it is assigned by the external display (40 in FIG. 1) on the vehicle or by parking in an area designated for vehicles serving the particular outbound sector. The passengers outbound from the terminal 20*b* simply locate and board an intracell vehicle lingering at the terminal and the vehicle eventually departs to transport the boarded passengers to their respective destinations such as destination 66, for example. Each passenger identifies their destination within the particular sector using the vehicle transit request input device 42 associated with the vehicle processor 32(FIG. 1). Of course, when there is no intracell vehicle lingering at the terminal to service the sector required by a particular passenger, the passenger makes a request using a telephone or other communications device at the terminal 20*b*** and the dispatching system dispatches an appropriate intracell vehicle to service the desired outbound route.

The third type of route is a combination route which may be employed during relatively higher traffic periods to route each intracell vehicle through the terminal **20*b* as much as possible. Referring to FIG. 3, suppose a transit request is made from request location 64 with the destination location being 66 within the transit cell. Rather than defining a dispatched vehicle soft route in terms solely of the line between the destination location 66 and request location 64, the preferred system creates a combination route, first creating the inbound route 60 to the cell terminal 20*b* and then an outbound route 62 to the sector including the destination location 66. The combination-type route assumes that in heavy travel periods, such as the morning and evening rush hours, a relatively large number of passengers will be traveling to and from the terminal location 20*b*** and sending the vehicle through the termination location will likely accommodate more passengers.

Any suitable predetermined definition may be used to determine whether a combination route will be created rather than a direct inbound/lateral route. In the preferred form of the invention, a combination route may be created if the destination location for the vehicle is outside of an area defined by a line extending from the request location to the terminal location and lines extending on either side of that request-to-terminal line at predetermined angles thereto.

Assigning intracell vehicle soft routes according to the invention facilitates modification of routes and the assignment process to accommodate different traffic periods. For example, in relatively low traffic periods, combination routes may not be used. Rather each inbound/lateral route may be defined simply in terms of the line between the request location and destination location and the certain distance on each side of that line. Also, the width of each inbound/lateral-type route may be varied to accommodate different conditions over the course of the day. In peak travel periods, it may be assumed that the intracell vehicles will fill to capacity fairly easily and each inbound/lateral route area may be defined with a relatively narrow area. During relatively low travel periods, the inbound/lateral routes may be defined with a relatively larger width to increase the chances of a transit request matching an assigned route. Also, the inbound routes do not necessarily have to be rectangular as shown in FIG. 3. Rather, the routes may be any desired shape, such as a shape that narrows toward the destination location. Similarly, the outbound routes need not be defined in terms of a relatively uniform sector or quadrant extending from the transit cell terminal but may be irregularly shaped to accommodate varying population densities across a transit cell, or to service particular neighborhoods within a transit cell.

An important aspect of the dispatching method according to the invention is that inbound and combination vehicle routes are defined by transit requests. Once an intracell vehicle route is defined by a particular transit request, subsequent requests having a request location and destination location included in the remaining portion of the route and a matching request direction are simply assigned to the vehicle servicing the assigned route. Furthermore, it is contemplated that each vehicle will be assigned a number of routes at any given time. Each vehicle will be traveling along a currently dispatched route and may be assigned future routes to service transit requests after the current route is completed. Regardless of the assigned route, the intracell vehicles are dispatched solely according to the user demand with no fixed routes but only temporary or soft routes defined by an initial transit request and servicing subsequent matching transit requests.

Figure 4:
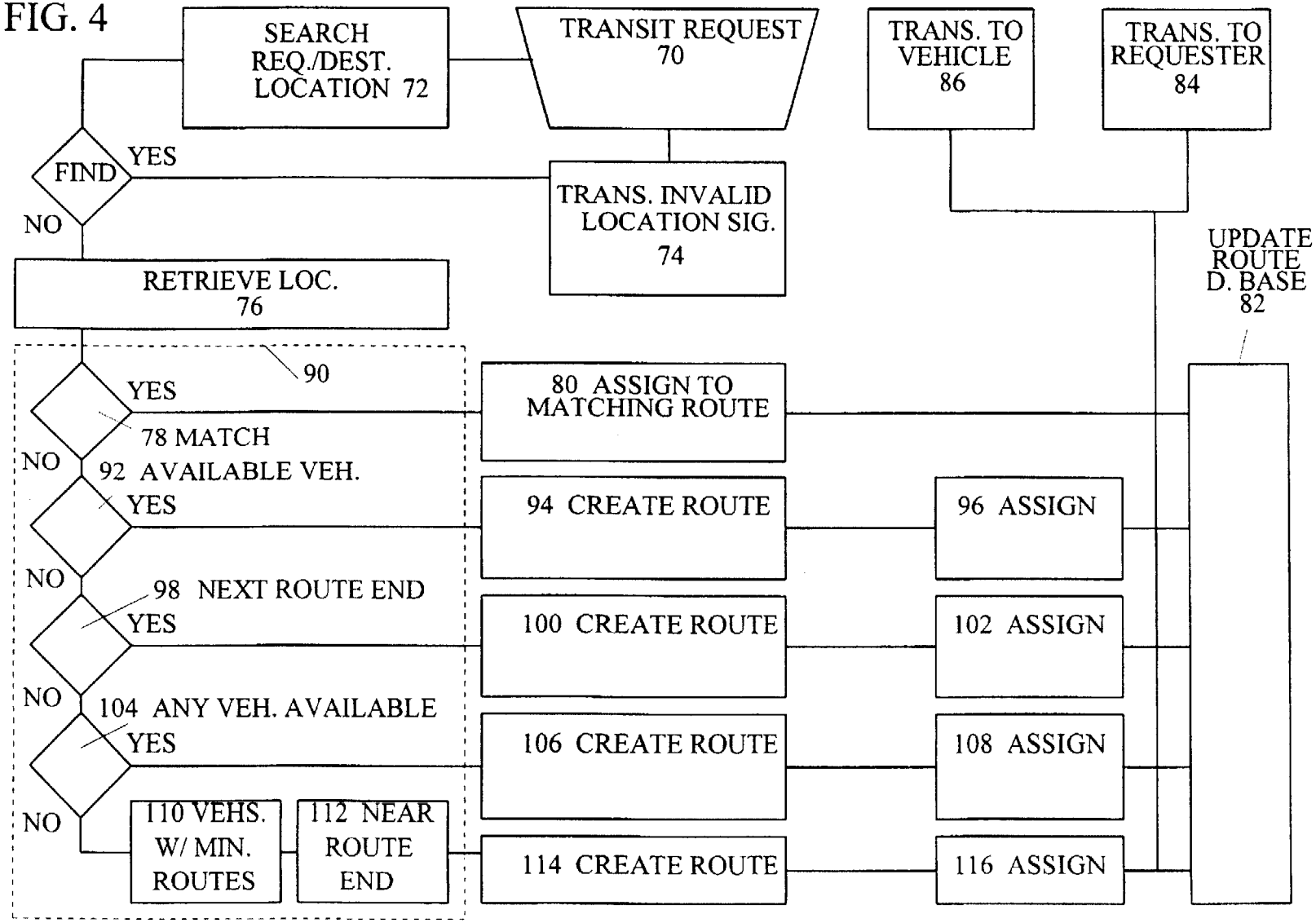
FIG. 4 is a schematic representation showing the preferred dispatching process according to the invention.

Another key element in the system is the manner in which transit requests are assigned to temporary intercell vehicle routes or soft routes which are created and modified automatically to accommodate transit requests in the most efficient manner. FIG. 4 illustrates the preferred dispatching process according to the invention. This preferred process may be used regardless of how locations within a particular transit cell are defined, whether by telephone number or otherwise. The process includes a matching system which matches a transit request to intracell vehicles assigned to previously dispatched routes, or creates a new soft route to service the transit request. Thus, the process is adapted to the preferred form of the invention in which routes are defined in terms of geographical areas and route direction.

Referring to FIG. 4, the dispatching process is initiated by the receipt of a transit request 70 at the dispatching processor 50 shown in FIG. 1. The transit request 70 includes at least the number of passengers, if more than one, and a request location and a destination location defined by some appropriate means, preferably by telephone numbers. The transit request 70 may also include an account ID number depending upon how the system charges users for the transit service. Immediately upon receipt of the transit request 70, the dispatching processor 50 at step 72 searches a location database in mass storage 52 (FIG. 1) for information on the request location and destination location, and perhaps searches an account ID database to determine if the request is from a valid account. If any of the information in the request 70 is not valid, the processor 50 at box 74 causes the request communication system 56 (FIG. 1) to send an appropriate message to the user and may terminate the connection or allow the user to re-enter a new transit request on the same telephone connection.

If all information in a transit request is valid, at box 76 the processor 50 retrieves information on the request location and destination location from the location database in mass storage 52 in order to determine the type of request being made, and to facilitate matching the transit request to an intracell vehicle route. The location information retrieved from the location database in storage 52 preferably includes a location definition for both the destination location and request location preferably in terms of Cartesian coordinates relative to the terminal location which may be assigned 0, 0. The location information may also include a physical location identifier or description for the request location and destination location. With the location definitions for the request location and destination location, the processor 50 at process box 76 determines which type of request is being made, either inbound, outbound, or combination, and for an inbound request determines a request direction. Once this request type information is determined by the processor 50, the processor at decision box 78, queries the route database in mass storage 52 to determine if a previously dispatched route matches the transit request. A match preferably occurs for inbound requests when both the request location and destination location are within the geographical area of the existing route and the request direction matches a direction of the route. A match occurs for an outbound route simply if the destination location is within a previously dispatched outbound-type route. Of course any match requires that the matched vehicle have passenger capacity to accommodate the requesting passenger or passengers.

If a match exists, the processor 50 assigns the transit request to the matching route at step 80 and updates the route database at step 82 with at least passenger information and perhaps other updating information. The other updating information for the route database may include a number of stops for the vehicle and perhaps a last destination location for the route if the transit request destination location is a location furthest along the matching route past the route defining destination location. Also, the processor 50 at step 84 causes the request communication means 56 and speech synthesizer 58 (both in FIG. 1) to send a signal back to the requesting passenger indicating which vehicle will pick up the requesting passenger. The processor 50 at step 86 also directs the vehicle communication system 54 (also FIG. 1) to send a dispatching signal to the vehicle assigned to service the transit request. The content of the dispatching signal will depend upon the type of operator interface used by the particular vehicle as will be discussed below with reference to FIG. 5.

The processor 50 may also calculate an estimated time of arrival at the request location and cause the request communication system 56 to send an estimated time of arrival indicator back to the requesting passenger. The type of estimated time of arrival information available according to the invention may cover a broad range, including very accurate estimates in terms of minutes. Alternatively, an estimated time of arrival indicator may simply be an indication that the request is assigned to a route along which a vehicle is currently traveling or a future route such as will be discussed below in cases where there is no match of existing routes.

Referring still to FIG. 4, if there is no match between the incoming transit request 70 and a currently defined route for one of the intracell vehicles, the dispatching processor 50 is programmed to go through a subprocess 90 to determine the most appropriate vehicle to service the new transit request. Once the process 90 identifies the most appropriate vehicle, the request information, including the request location and destination location, is used to define a new soft route for that vehicle.

Any number of subprocesses may be used to define the most appropriate vehicle to handle an incoming transit request that does not match an existing dispatched soft route. FIG. 4 illustrates one preferred process 90 for determining the most appropriate vehicle. If no existing vehicle route matches the transit request at step 78, the preferred next step 92 is to determine if there is an undispatched intracell vehicle within a certain pre-defined range of the request location. The processor 50 uses the route database in mass storage 52 in making this determination. If an undispatched intracell vehicle is within the predefined range, the processor 50 at step 94 creates a new route for the vehicle using the request information and then at step 96 assigns the transit request to that newly created vehicle route which, of course, now matches the transit request. The process from this point continues with steps 82, 84, and 86 discussed above with the processor 50 updating the route database and transmitting an appropriate confirmation signal to the requesting passenger and a dispatching signal to the dispatched vehicle.

If at decision box 92 there is no undispatched vehicle within the predetermined range from the request location, the preferred process 90 includes at step 98 determining if within a predetermined range or distance from the request location there is a route end for a route currently being serviced by one of the intracell vehicles. To accomplish this step, the dispatching processor again queries the route database in storage 52. If there is a current route end within the particular range, the processor 50 at step 100 creates a new soft route using the information from the request and then at step 102 assigns the transit request to that vehicle. The assigned route is then the next soft route defined for the intracell vehicle after the vehicle completes the soft route it is then servicing. The processor 50 then updates the route database at step 82 and then transmits at box 84 a confirmation signal to the requester and at box 86 transmits a dispatch signal to the matching intracell vehicle.

If there is no final route end within the predetermined range from the request location, the processor 50 at step 104 queries the route database to determine if there is any undispatched vehicle available to service the transit request. If there is an undispatched vehicle, the processor 50 at step 106 creates a new soft route using the transit request information, and at step 108, assigns that soft route and transit request to the identified vehicle. Again, once the transit request is matched to a dispatched route or vehicle soft route, the processor 50 updates the route database at box 82 and causes the vehicle communication system to transmit at box 86 a dispatch signal to the assigned vehicle. The processor 50 also causes the request communication means to transmit at step 84 an appropriate confirmation signal to the requesting user or passenger.

Finally, if there are no undispatched vehicles available to service the initiating transit request, the processor 50 simply searches the routed database at 110 to identify the intracell vehicle or vehicles with the fewest assigned routes, then among those vehicles at step 112 identifies the vehicle with the final route end nearest to the request location. Once this optimal vehicle is identified, a new route is created at step 114 for the vehicle using the transit request, and the vehicle is assigned to service the request at step 116. Also, similarly to each case in which a transit request is matched to a dispatched soft route, the processor 50 updates the route database at box 82, causes the vehicle communication means to transmit at box 86 an appropriate dispatch signal to the dispatched vehicle, and causes the request communication means to transmit to the requesting user or passenger at box 84 an appropriate confirmation signal.

Although other parameters may be used to choose the best vehicle for servicing a new transit request, the parameters set out in the subprocess 90 in FIG. 4 are preferred. Alternatively, more or fewer decision steps such as those at 78, 92, 98, and 104 may be used to create routes using the incoming transit request.

The preferred form of the invention also includes means for maintaining performance data regarding each intracell dispatching system. For example, the dispatching processor 50 may be programmed to capture a time for each incoming transit request and also capture the time the dispatched vehicle reaches the destination location for the request. This time information, along with the request and destination location, may be used to schedule the number of vehicles for a particular transit cell for a particular time of day. Also, this performance information may be used to optimize soft route shapes to most efficiently service a particular transit cell.

Figure 5:
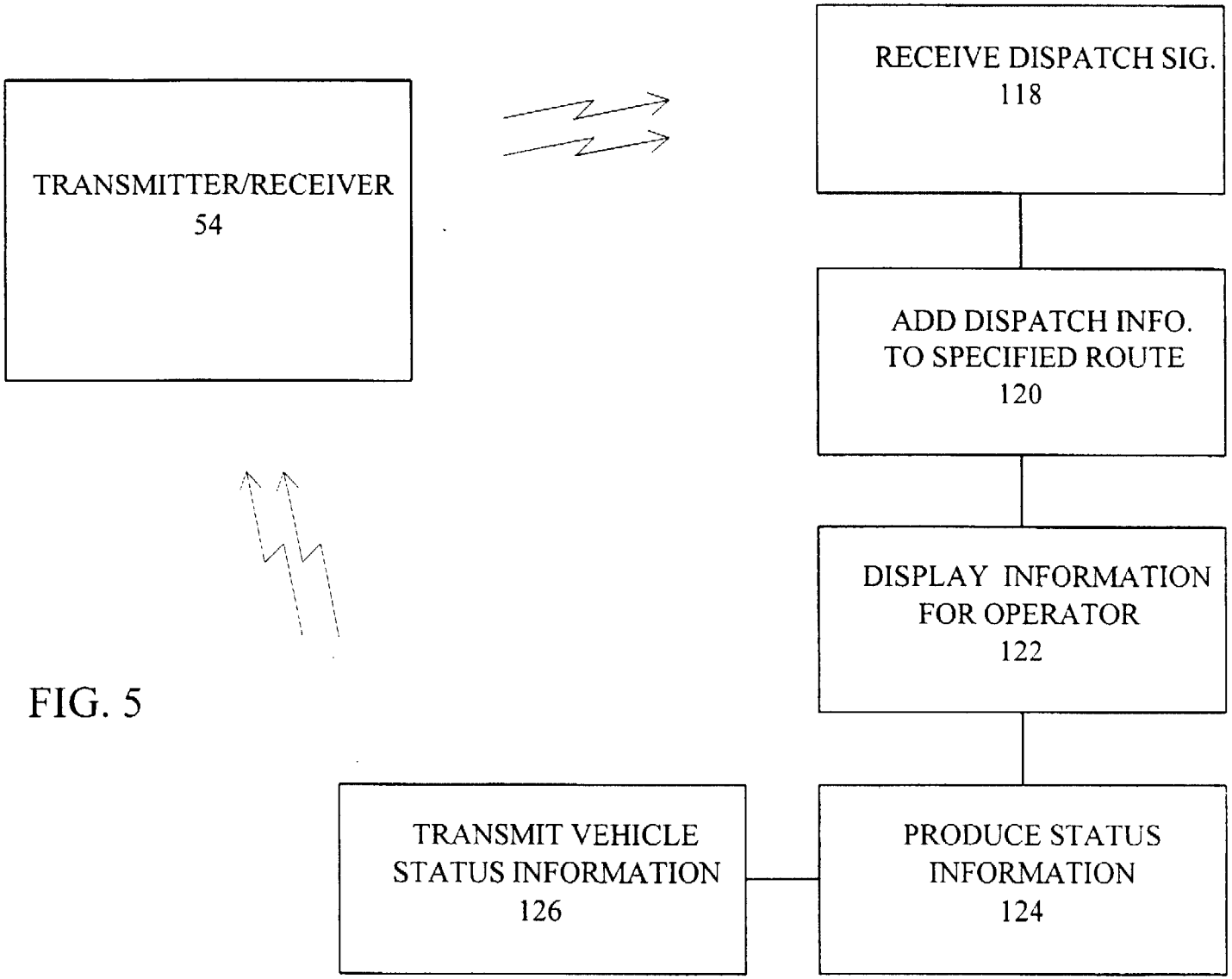
FIG. 5 is a schematic drawing showing the process of receiving and using dispatching signals at an intracell vehicle.

FIG. 5 illustrates the preferred process performed at each intracell vehicle according to the invention shown in FIG. 1. At step 118, the intracell vehicle receiver/transmitter 30 (FIG. 1) receives a dispatch signal from the transit cell dispatching system 12 including dispatch information or transit request service information for the intracell vehicle processor 32 (FIG. 1). The intracell vehicle processor 32 then at step 120 associates the received dispatch information with the appropriate dispatched route. Where a dispatch signal from the dispatch system 12 includes information concerning a transit request assigned to the current route which the vehicle is servicing, the processor 32, also at step 122, adds the request and destination location to the operator's display 34 (FIG. 1). When a dispatch signal transmits information concerning a transit request that is assigned to a future route assigned to the vehicle, the vehicle processor 32 stores the request and destination location and any other required information in storage device 36 for recall and display when the vehicle services that future soft route.

It should be noted that the type of route dispatched to a particular intracell vehicle need not be transmitted to the vehicle operator. Rather, the required request and destination location information is simply displayed on the display 34 (FIG. 1) and the operator simply drives through these particular displayed locations in the most efficient manner which they may determine. The dispatch signal may, however, include in addition to the information regarding the request and destination locations, and an identifier that indicates whether a particular location is a request location or a destination location. This indicator may be displayed to the driver so the driver knows where passengers will be entering the vehicle and where passengers will be exiting the vehicle.

The type of transit request service information included in a dispatch signal transmitted from the dispatch system 12 to each intracell vehicle depends upon the type of display 34 (FIG. 1) utilized by the intracell vehicle. For example, the vehicle display 34 may simply list request destination locations by physical descriptions such as street addresses. In this case the transit request service information may include request and destination location physical descriptions. The physical descriptions may be arranged in some optimum order on the display 34 to help guide the vehicle operator. Of course, since the route is not fixed, the driver may use his or her own intuition and knowledge of an area to vary the actual route along which they travel in order to reach each request and destination location. This simple list of request and destination locations is relatively simple to implement but requires a relatively higher level of driver skill. That is, for a simple listing of request and destination locations by physical descriptions, the driver must have a good knowledge of the area being serviced.

Alternatively to a display including a simple list of request and destination location physical descriptions, the operator display 34 may include an electronically generated map covering the area for the currently assigned route. In this preferred form of the invention, the vehicle processor 32 preferably accesses transit cell map information in mass storage 36. When the vehicle starts along a new route, the route definition associated with the particular route causes the vehicle processor 32 to retrieve the pertinent portion of the map for display upon the vehicle display. Request and destination locations may then be displayed as points on the map. Along with the point on the map, the display for each request and destination location may also include a physical description of a location such as a street address along with a symbol indicating whether the location is a request location or a destination location. Thus, the transit request service information transmitted to the vehicle in this form of the invention may include request and destination locations in terms of cartesian coordinates for example, physical location descriptions in terms of street addresses, and information to identify each location as either a request location or destination location.

In addition to request and destination location information, the transit request service information of each dispatch signal will include means for allowing the desired vehicle receiver to recognize the signal as intended for that particular vehicle and a particular route assigned to the vehicle. In the preferred form of the invention, this vehicle and route discriminating means may comprise a vehicle identifying value unique to the intended vehicle and a vehicle route identifying value unique to the intended route.

The process at the vehicle also includes collecting status information at step 124 and at step 126 transmitting that information back to the dispatching system 12. The status information most importantly includes the current location of the vehicle and may also include occupancy information as well as other pertinent status information. Once collected, this status information is passed to the vehicle transmitter/receiver 30 (FIG. 1) which then transmits the status information back to the dispatch system 12. The dispatch system 12 uses this status information to update the route database with at least current vehicle location so that the dispatch processor 50 may accurately assign transit requests.

Location information may be collected several different ways. A relatively low cost approach is simply to have the operator manually enter a signal when the vehicle reaches a particular displayed request or destination location. The signal may be entered through a keyboard or mouse associated with the processor 32, or through an interactive screen. For example, the screen may comprise a touch sensitive screen and the operator may simply touch the displayed location to produce the desired vehicle location signal. Alternatively, the operator may use a suitable device to move a cursor either to a map location or a physical location description on a list. The dispatch processor 50 may include programming by which it may extrapolate accurate locations for each vehicle using the transmitted status information and the next logical location to which the vehicle will travel.

Alternatively, vehicle location information may be acquired through a suitable device such a GPS device or any other suitable location sensing system 44 (FIG. 1). Where the vehicle includes a location sensing system 44, the vehicle processor 32 simply collects vehicle position information periodically and transmits the information to the dispatching system 12. This vehicle location sensing form of the invention has the advantage of requiring no operator input. The operator of the intracell vehicle simply travels along any desired path to pass through each displayed request and destination location. The dispatch processor 50 may be programmed to assume that a passenger pick up or drop off, as the case may be, occurs when an intracell vehicle passes through or near a location assigned to it.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the dispatching system is discussed in terms of a separate system 12 for each transit cell, a single system 12 may be used to dispatch vehicles or a plurality of different cells. Also, although the dispatch system 12 is discussed above in terms of a single processor and could be implemented with a single personal computer or work station, the system may be implemented on a distributed computing system having many networked processors perhaps operating in parallel to perform the steps required of the processor shown at 50 in FIG. 1.

I claim:

1. A method of dispatching public transit vehicles to service transit requests within a geographic transit cell, the method comprising the steps of:

(a) at a dispatching computer system, receiving a plurality of transit requests, each transit request being transmitted to the dispatching computer system through a transit request communication system and including a destination location identifier and a request location identifier;

(b) at the dispatching computer system, periodically receiving vehicle status signals from a plurality of intracell vehicles, each vehicle status signal containing vehicle status information;

(c) for each transit request, associating the request location identifier with a request location within the transit cell, and associating the destination location identifier with a destination location within the transit cell;

(d) for each transit request, determining a request direction from the request location and the destination location;

(e) assigning each transit request to a matching intracell vehicle route of an intracell vehicle having available passenger capacity, the matching intracell vehicle route having a route area including the request location and the destination location associated with the respective transit request, and also having a route direction matching the request direction of the respective transit request; and (f) for each transit request, after assigning the respective transit request to the matching intracell vehicle route, transmitting from the dispatching computer system a dispatch signal to an intracell vehicle servicing the matching intracell vehicle route, the dispatch signal including transit request service information.

2. The method of claim 1 wherein the vehicle status information includes a vehicle current location value, an occupancy value, and a current vehicle route identifier, all for the respective intracell vehicle transmitting the particular vehicle status signal.

3. The method of claim 1 wherein each request direction comprises a value representing the angular difference between a line defined from the request location to the destination location for the respective transit request and a line extending from the request location in a predetermined reference direction.

4. The method of claim 1 wherein each dispatch signal includes a vehicle route identifying value unique to the respective matching route.

5. The method of claim 1 wherein the transit request service information for each dispatch signal includes a request location description and a destination location description.

6. The method of claim 1 wherein the transit request service information for each dispatch signal includes a request location value and a destination location value.

7. The method of claim 1 further comprising the step of:

(a) defining an a new intracell vehicle route when the request location and destination location associated with one of the transit requests are not included in a previously existing intracell vehicle route.

8. The method of claim 1 further comprising the step of:

(a) defining an a new intracell vehicle route when the request direction defined by said transit request does not match a direction of a previously existing intracell vehicle route.

9. The method of claim 1 wherein each intracell vehicle is assigned an intracell vehicle route type chosen from a group comprising:

(a) an inbound route defined by an area including a route line from the request location to the destination location associated with one of said transit requests, and a predetermined distance on either side of said route line; and (b) an outbound route defined by predetermined static boundary lines extending from a cell terminal location within the cell.

10. The method of claim 9 wherein the group from which the intracell vehicle route type is chosen further comprises:

(a) a composite route consisting of an inbound route terminating at the cell terminal location and an outbound route.

11. The method of claim 10 including the step of creating a composite route in response to a transit request in which the destination location associated with the transit request is outside of an area defined by a line extending from the request location to the cell terminal location and lines extending at predetermined angles from the terminal location on either side of the line extending from the request location to the terminal location.

12. The method of claim 1 wherein the transit request communication system comprises a local telephone system operating in the transit cell, the destination location identifier comprises a destination telephone number of a telephone at the destination location, and the request location identifier comprises a request telephone number of a telephone at the request location and further comprising the step of:

(a) capturing the request telephone number through an incoming call identification service.

13. The method of claim 12 wherein the dispatching computer system includes a data storage device storing a database comprising telephone numbers assigned to telephones within the transit cell, each stored telephone number related to a location value, each location value including an X-value representing the distance between a physical location related to the stored telephone number and a terminal location within the transit cell in an X direction, and a Y-value representing the distance between the physical location related to the stored telephone number and the terminal location in a Y direction perpendicular to the X direction.

14. The method of claim 13 wherein:

(a) the step of associating the request telephone number with the request location includes searching the location database for the request telephone number and retrieving the location value related to the request telephone number; and (b) the step of associating the destination telephone number with the destination location includes searching the location database for the destination telephone number and retrieving the location value related to the destination telephone number.

15. The method of claim 12 further comprising the steps of maintaining the telephone connection for each transit request and announcing a vehicle identifier for the particular intracell vehicle assigned to service the respective transit request.

16. The method of claim 15 further comprising the steps of:

(a) for each transit request determining an estimated time of arrival of the particular assigned intracell vehicle to the request location associated with the respective transit request; and (b) announcing said estimated time of arrival through the telephone connection through which the transit request is made.

17. A public transit system for transporting passengers within a geographic transit cell, the public transit system comprising:

(a) a plurality of intracell vehicles for transporting passengers within the transit cell;

(b) status signal transmission means mounted in each intracell vehicle for transmitting status signals, each status signal including vehicle status information;

(c) a terminal located within the transit cell, the terminal having an area for at least one of the intracell vehicles at a time to park and allow passengers to load and unload;

(d) transit request communication means for receiving transit requests transmitted across a transit request communication system, each transit request including a request location identifier and a destination location identifier;

(e) intracell vehicle communication means for receiving the vehicle status signals transmitted from the intracell vehicles, and for transmitting dispatch signals to the intracell vehicles, each dispatch signal corresponding to a transit request and including transit request service information;

(f) dispatch signal display means mounted in each intracell vehicle, each dispatch signal display means for receiving dispatch signals affecting the particular intracell vehicle in which it is mounted and for displaying vehicle operator information contained within the transit request information associated with the respective dispatch signal; and (g) dispatching means associated with the transit request communication means and the intracell vehicle communication means, the dispatching means for receiving the transit requests from the transit request communication means and vehicle status signals from the intracell vehicle communication means, and for each transit request associating the respective request location identifier with a unique request location value within the transit cell, associating the respective destination location identifier with a unique destination location value within the transit cell, determining a request direction using the request and destination location, assigning the respective transit request to a matching intracell vehicle route, and causing the intracell vehicle communications means to transmit a dispatch signal corresponding to the transit request, the matching intracell vehicle route having a route area including the request location and the destination location associated with the respective transit request and also having a route direction matching the request direction of the respective transit request.

18. The public transit system of claim 17 wherein the vehicle display means includes a screen display for displaying a geographic area covered by a vehicle route and for displaying request locations and destination locations assigned to the displayed vehicle route.

19. The public transit system of claim 17 further comprising route database storage means associated with the dispatching means, the route database storage means storing route parameters for each vehicle route assigned to the plurality of intracell vehicles, the route parameters defining the geographic area covered by the particular assigned route and including a route direction.

20. The public transit system of claim 17 further comprising:

(a) a vehicle transit request input device mounted in each intracell vehicle, the vehicle transit request input device enabling passengers to enter a respective destination location identifier associated with their desired destination.

21. The public transit system of claim 17 wherein the transit request communication system comprises a local telephone system operating throughout the transit cell area, the request location identifier comprises a request telephone number, and the destination location identifier comprises a destination telephone number.

22. The public transit system of claim 21 further comprising incoming call identification means associated with the transit request communications means for capturing the request telephone number of each transit request.

23. The public transit system of claim 22 further comprising speech synthesizing means associated with the transit request communication means for generating a dispatched vehicle identifying announcement for each transit request and transmitting the vehicle identifying announcement over the connection created by the transit request.

24. The public transit system of claim 23 further comprising vehicle pick-up estimation means associated with the dispatching means for producing an estimated time of arrival of the assigned intracell vehicle at the request location associated with the respective transit request, and wherein the speech synthesizing means is also for creating an estimated time of arrival announcement for each transit request and transmitting the respective estimated time of arrival announcement over the connection created by the transit request.

25. The public transit system of claim 21 further comprising:

(a) database storage means associated with the dispatching means and storing telephone numbers associated with valid request locations and destination locations throughout the transit cell, each telephone number having related thereto a unique location value representing a location within the transit cell associated with the telephone number.

26. The public transit system of claim 25 wherein each telephone number stored in the database storage means has related thereto a physical description of the location within the transit cell associated with the telephone number.

27. The public transit system of claim 26 wherein the vehicle display means includes a screen display for displaying the physical description related to each request location and each destination location assigned to the displayed vehicle route.

28. A method for dispatching public transit vehicles to service transit requests within a geographic transit cell, the method comprising the steps of:

(a) at a dispatching computer system, receiving a plurality of transit requests, each transit request being transmitted to the dispatching computer system through a transit request communication system and including a destination location identifier and a request location identifier;

(b) at the dispatching computer system, periodically receiving vehicle status signals from a plurality of intracell vehicles, each vehicle status signal containing vehicle status information;

(c) for each transit request, associating the request location identifier with a request location within the transit cell, and associating the destination location identifier with a destination location within the transit cell;

(d) defining a new intracell vehicle route when the request location and destination location associated with one of the transit requests are not included in a previously existing intracell vehicle route;

(e) assigning each transit request to a particular intracell vehicle and vehicle route for servicing the request; and (f) for each transit request, after assigning the respective transit request to the particular intracell vehicle and vehicle route, transmitting from the dispatching computer system a dispatch signal to said particular intracell vehicle, the dispatch signal including transit request service information.

29. The method claim 28 further comprising the step of:

(a) receiving a passenger's destination location identifier through a vehicle transit request input device mounted in one of the intracell vehicles.

30. A method for dispatching public transit vehicles to service transit requests within a geographic transit cell, the method comprising the steps of:

(a) at a dispatching computer system, receiving a plurality of transit requests, each transit request being transmitted to the dispatching computer system through a transit request communication system and including a destination location identifier and a request location identifier;

(b) at the dispatching computer system, periodically receiving vehicle status signals from a plurality of intracell vehicles, each vehicle status signal containing vehicle status information;

(c) for each transit request, associating the request location identifier with a request location within the transit cell, and associating the destination location identifier with a destination location within the transit cell, and determining a request direction from the request location and destination location;

(d) defining a new intracell vehicle route when the request direction defined by said transit request does not match a direction of a previously existing intracell vehicle route (e) assigning each transit request to a particular vehicle route defined by a route direction and a geographical area, the route direction matching the request direction of the respective transit request and the geographical area including the request location and the destination location, the particular vehicle route being assigned to a particular intracell vehicle; and (f) for each transit request, after assigning the respective transit request to the particular vehicle route assigned to the particular intracell vehicle, transmitting from the dispatching computer system a dispatch signal to said particular intracell vehicle, the dispatch signal including transit request service information.

31. A method of dispatching public transit vehicles to service transit requests within a geographic transit cell, the method comprising the steps of:

(a) at a dispatching computer system, receiving a plurality of transit requests, each transit request being transmitted to the dispatching computer system through a transit request communication system and including a destination location identifier and a request location identifier;

(b) at the dispatching computer system, periodically receiving vehicle status signals from a plurality of intracell vehicles, each vehicle status signal containing vehicle status information;

(c) for each transit request, associating the request location identifier with a request location within the transit cell, and associating the destination location identifier with a destination location within the transit cell;

(d) assigning each transit request to a particular vehicle route defined by a geographical area which includes the request location and the destination location, each particular vehicle route being assigned to a particular intracell vehicle;

(e) for each transit request, after assigning the respective transit request to the particular vehicle route and intracell vehicle, transmitting from the dispatching computer system a dispatch signal to said particular intracell vehicle, the dispatch signal including transit request service information; and (f) wherein each intracell vehicle route comprises an intracell vehicle route type chosen from a group comprising:

(i) an inbound route defined by an area including a route line from the request location to the destination location associated with one of said transit requests, and a predetermined distance on either side of said route line; and (ii) an outbound route defined by predetermined static boundary lines extending from a cell terminal location within the cell.

* * * * *